United States Patent [19]

Shawki et al.

[11] Patent Number: 4,923,566

[45] Date of Patent: May 8, 1990

[54] METHOD OF PACIFYING STICKIES IN PAPER

[75] Inventors: Shamel M. Shawki, Mississauga; Richard N. Van Oss, Bramalea, both of Canada

[73] Assignee: Nalco Chemical Company, Naperville, Ill.

[21] Appl. No.: 343,614

[22] Filed: Apr. 26, 1989

[30] Foreign Application Priority Data

Jul. 19, 1988 [CA] Canada ..... 572380

[51] Int. Cl.[5] ..... D21H 19/10

[52] U.S. Cl. ..... 162/135; 162/136; 162/147; 162/158; 162/175; 162/177; 162/184; 162/199; 162/DIG. 4; 427/391

[58] Field of Search ..... 162/135, 199, 184, DIG. 4, 162/160, 136, 175, 127, 147, 158, 186, 210, 287.3, 177; 427/391

[56] References Cited

U.S. PATENT DOCUMENTS

| | | | |
|---|---|---|---|
| 2,309,089 | 1/1943 | Bauer et al. | 162/184 |
| 2,739,870 | 3/1956 | Senkus | 162/160 |
| 2,739,871 | 3/1956 | Senkus | 162/160 |
| 3,024,160 | 3/1962 | Kapral | 162/184 |
| 3,062,699 | 11/1962 | Raphael et al. | 162/184 |

*Primary Examiner*—Peter Chin

*Attorney, Agent, or Firm*—Michael E. Wheeler; Donald G. Epple; Anthony L. Cupoli

[57] ABSTRACT

Urea is used to pacify "stickies" in the manufacture of paper products, particularly coated boxboard.

7 Claims, No Drawings

METHOD OF PACIFYING STICKIES IN PAPER

FIELD OF THE INVENTION

The present invention is concerned with pacifying "stickies" in the manufacture of paper products, particularly coated boxboard.

BACKGROUND TO THE INVENTION

"Stickies" have long been identified as a troublesome contaminant in the manufacture of paper using secondary or recycled fibre as an ingredient. Stickies are, as the name suggests, tacky regions present in the paper product being formed. Typical stickies are non-hardening glues, such as those used on packaging tapes, on price labels, masking tape, office or other stationery, adhesive or any other application where quick tacking properties are required.

The contaminants that form the stickies enter the paper-making process with secondary fibre sources, i.e., recycled paper products. When recycled paper on which glue had been applied is defibred, the glues will form particulate contaminants. The surface of these particles remains adhesive after they have been retained on the surface of the paper being made. The adhesive surface of these stickies can cause problems by picking up debris in the furnish such as ink, sand or fibre particles.

In a typical papermaking operation, a pulp slurry containing about 2 to 3% of fibre in water is subjected to various filtration, drying, callendering, surface coating, reeling and winding steps.

An industry where stickies are especially troublesome is the boxboard making industry. Boxboard is used for making boxes for consumer products such as detergent boxes, etc. Often the one surface of the boxboard, known as the topliner, is made of a whiter grade of paper than the other surface, known as the backliner. This topliner is also often coated (usually with clay) in order to impart a white smooth surface suitable for printing.

The presence of stickies is often made apparent during the unwinding of the boxboard rolls just prior to printing and converting them to boxes.

When stickies are present in the backliner two problems may occur:

(1) Some of the stickies from the backliner may transfer to the topliner or coated topliner. This causes a visible blemish on the surface to be printed, which is unacceptable. Furthermore, the adhesive material may be transferred from the paper surface onto the printing press, subsequently causing a blemish on the paper surface with each application of the press to the paper surface.

When this occurs, it is necessary to stop production and to clean the printing press. Often the paper supplier is required to pay for the lost production and the cost of cleaning the printing press.

(2) Particles from the topliner, or the clay coating the topliner, may be transferred to the backliner during the unwinding of the paper rolls because they stick to the tacky surface of the stickies present on the backliner. The surface defects caused by this phenomenon are often referred to in the trade as "hickies". The printed product containing hickies is unacceptable from a packaging and marketing standpoint and is rejected for end use. Often this board and the associated lost printing time are charged to the boxboard manufacturer.

SUMMARY OF THE INVENTION

The present invention provides a process for pacifying stickies in the papermaking process by applying urea to the paper product.

It has been found that urea will coat the surface of the stickies and "pacify" them, i.e., render the surface non-adhesive. Thus although the stickies are still present, their surface is no longer tacky and hence will not cause the problems described above.

DESCRIPTION OF THE PREFERRED EMBODIMENTS

It is preferred to apply the urea to the paper at or towards the dry end of the papermaking operation. In a typical operation, the paper product is dried then passes between callendering rolls, which may be present in one or more stacks of callendering rolls, known as callender stacks. Water or an aqueous solution of various additives such as starch or carboxymethylcellulose is often applied to the paper surface at the callendering stacks. The liquid is applied from a box which has an outlet permitting the liquid to flow at a predetermined rate onto the surface of a callendering roll. From the surface of the callendering roll the liquid is transferred onto one of the surfaces of the paper. If liquid is to be applied to both surfaces of the paper then a box will be provided at an adjacent callendering roll and the liquid will be applied to the other surface of the paper. If the box contains only water, it is known as a water box. If it contains a starch solution it is known as a starch box. If it contains a carboxymethylcellulose solution it is known as a carboxymethylcellulose box. The urea can be dissolved in the water in the box and can be applied to the paper with the water and the other additives, if any.

The amount of urea to be applied can be determined by those skilled in the art. The minimum amount is that amount which will pacify all stickies. The presence of unpacified stickies is made readily apparent during the unwinding of paper rolls by the transfer of stickies from the backliner to the topliner or the transfer of particles from the topliner (or from the coating of the topliner) to the backliner. The amount of urea should be at a level where this is eliminated.

Another indication of the presence of unpacified stickies is a characteristic snapping sound caused by the tacky surface of the stickies coming in contact with the draw rolls at the dry end of the paper machine. This sound usually disappears when enough urea has been added to the paper. There is no advantage in using more urea than is necessary to pacify stickies but, of course, it is desirable to set the level above the absolute minimum, to provide a safety factor. Different pulp furnishes will contain different amounts of adhesive contaminants and hence will require different amounts of urea, but appropriate amounts can readily be determined by those skilled in the art. It is believed that amounts of urea not less than 0.1 $g/m^2$ of paper surface and not more than 2.0 $g/m^2$ of paper surface will usually be appropriate. Preferably amounts of urea in the range 0.20 to 0.50 $g/m^2$ are used.

The urea is conveniently supplied as an aqueous solution. There is no criticality in the concentration of the urea solution but economics favour supplying the urea as a concentrated solution. It is desirable that the solution should contain a biocide to prevent unwanted microbial growth in the water box (or starch box) and on the paper. A suitable biocide is hexahydro-1,3,5-tris (2-hydroxyethyl)-S-triazine available under the trademark Grotan BK from Gray Products of Toronto. Other suitable biocides are Kathon 886 available from Rohm & Haas and Thiostat BM 2213 from Uniroyal Chemical, Elmira, Ontario. A suitable composition is, by weight, 40.0% urea, 0.1% biocide and 59.9% water.

One way to control the amount of urea fed to the paper is by varying the concentration of urea in the water box or starch box. Typically, the concentrated urea solution described above will be diluted in the paper mill so that the concentration of urea in the water box or starch box is between 0.5 and 5.0% and preferably between 1.0 and 2.5% depending on the amount of stickies present. The higher the concentration of urea in the box the more urea is incorporated into the paper and the more stickies can be treated. A convenient place to dilute the urea is in the tank where starch or carboxymethylcellulose solutions are prepared to be fed to boxes at the callendering stacks.

It is known from Canadian Patent No. 1,156,803 to apply an aqueous solution of urea and colloidal silica to provide a non-skid surface. That patent is concerned primarily with imparting a non-skid surface to linerboard; it is not concerned with and does not mention stickies. The present invention is, of course, concerned with stickies and the urea solution which is used to solve the stickies problem is free of colloidal silica.

The invention will be further illustrated in the following examples.

EXAMPLE 1

An evaluation of the use of urea was carried out in a paper mill in Ontario. This mill produces coated boxboard and uses secondary fibre (recycled paper). The mill has had stickies problems for years and no prior treatment was ever successful.

A solution composed of, by weight, 40.0% urea, 59.9% water and 0.1% of biocide Grotan was added to the tank in which a starch solution was prepared. The solution of starch and urea was then put in a starch box from which the solution is applied to the backliner of the paper following the dryer. The amount used was such that the concentration of urea in the box was 1.1%. Under these conditions, the amount of urea incorporated into the paper was calculated to be 0.2 g urea/$m^2$ paper. The urea was applied immediately after the mill experienced a severe outbreak of stickies having as their source the raw fibre supply. The presence of stickies was indicated by the audible picking of the contaminants as the paper passed through the pull rolls. Transfer of stickies from the backliner to the topliner was visually apparent following in-mill sheeting.

At the above dosage of 0.2 g urea/$m^2$ paper, these problems were alleviated but not completely eliminated. Therefore, the concentration of urea was doubled to 2.2% corresponding to 0.4 grams urea/$m^2$ paper. At this level, the audible picking of the stickies at the pull roll ceased. The product was sheeted and no transfer of stickies from the backliner to the topliner was observed. The product was sent to the customer for conversion to finished product. The customer did not experience any of the problems associated with stickies while printing on this paper. Although stickies were visually observable on the backliner they were in an innocuous form.

The level of urea was subsequently varied in the range of 0.25 to 0.51 g/$m^2$ to deal with varying amounts of stickies contamination in their recycled fibre feedstock.

EXAMPLE 2

A qualitative laboratory evaluation procedure was used to screen candidates for chemical passivation of stickies.

(1) A strip of adhesive was applied on a sheet of paper using an "adhesive gun" "Scotch Brand ATG 752".
(2) The paper was quickly dipped in water containing various concentrations of urea (see Table II).
(3) The paper was dried in an oven at 100°-105° C. for 5 minutes.
(4) The paper was placed on the bench with the sticky side up.
(5) A second "clean" sheet of paper was placed on the first and uniform pressure was applied manually on it.
(6) The two sheets were peeled away from each other.

RESULTS

TABLE II

| Experiment | % Urea in Water | Observations |
|---|---|---|
| 1 | 0 | Blank. While peeling the papers. considerable damage is done due to tearing. Surface of the adhesive remains sticky. |
| 2 | 0.2% | Considerable improvement. Surface of adhesive much less sticky to the touch and only a little damage is done while peeling the paper. |
| 3 | 2% | Adhesive surface passivated completely. Not sticky to the touch and almost no damage done by peeling. |
| 4 | 40% | A visible white deposit of urea onto the adhesive surface which is not sticky at all. Papers peel away extremely easy with absolutely no damage. |

What we claim as our invention is:

1. In a paper making process in which paper furnish including recycled fibre is passed over drying rolls, the improvement for the purpose of pacifying stickies in the paper product, which comprises applying to the paper between the drying rolls and the finished produce reel an aqueous solution of urea, the amount of urea applied being such that the paper product bears a coating surface of urea in an amount between 0.1 g/$m^2$ and 2.0 g/$m^2$ of paper surface.

2. A process according to claim 1 wherein the urea is applied in aqueous solution from a water box, starch box or carboxymethylcellulose box.

3. A process according to claim 1 wherein the urea is applied at an amount in the range of 0.2 to 0.5 g/$m^2$ of paper surface.

4. A process according to claim 1 wherein the paper product is coated boxboard.

5. A paper product made from a paper furnish that included recycled fibre and is coated with silica-free urea in an amount between 0.1 g/$m^2$ and 2.0 g/$m^2$ of paper surface.

6. A paper product as claimed in claim 5 which is coated boxboard.

7. A paper product made from a paper furnish that included recycled fibre and is coated with silica-free urea in an amount in the range 0.2 to 0.5 g/$m^2$ of paper surface.

* * * * *

UNITED STATES PATENT AND TRADEMARK OFFICE

CERTIFICATE OF CORRECTION

PATENT NO. : 4,923,566

DATED : MAY 8, 1990

INVENTOR(S) : SHAMEL M. SHAWKI & RICHARD N. VAN OSS

It is certified that error appears in the above-identified patent and that said Letters Patent is hereby corrected as shown below:

Front page, Assignee: Nalco Chemical Company
Naperville, Illinois

LETTERS PATENT SHOULD READ AS:

Assignee: Alchem Inc., Burlington, Ontario, Canada

Column 4, Claim 1, being such that the paper product bears a coating surface

LETTERS PATENT SHOULD READ AS:

being such that the paper product bears a surface coating

Signed and Sealed this

Third Day of September, 1991

*Attest:*

*Attesting Officer*

HARRY F. MANBECK, JR.

*Commissioner of Patents and Trademarks*